US008707609B2

(12) United States Patent
Fisher

(10) Patent No.: US 8,707,609 B2
(45) Date of Patent: Apr. 29, 2014

(54) FIREARM SIGHT TOOL

(76) Inventor: Danny Fisher, El Cajon, CA (US)

( * ) Notice: Subject to any disclaimer, the term of this patent is extended or adjusted under 35 U.S.C. 154(b) by 107 days.

(21) Appl. No.: 13/438,681

(22) Filed: Apr. 3, 2012

(65) Prior Publication Data

US 2013/0255128 A1 Oct. 3, 2013

(51) Int. Cl.
*F41G 11/00* (2006.01)
*F41C 27/00* (2006.01)

(52) U.S. Cl.
USPC ..... 42/124; 42/90; 42/111; 33/274

(58) Field of Classification Search
USPC ..... 42/108, 124, 90, 111, 137, 143; 33/274, 33/286
See application file for complete search history.

(56) References Cited

U.S. PATENT DOCUMENTS

| | | | | |
|---|---|---|---|---|
| 5,864,957 | A | 2/1999 | Small | |
| D620,547 | S * | 7/2010 | Bietsch | D22/199 |
| 8,316,573 | B2 * | 11/2012 | Bietsch | 42/124 |
| D675,698 | S * | 2/2013 | Bietsch | D22/108 |
| 8,397,422 | B2 * | 3/2013 | Bietsch | 42/124 |
| 2011/0167702 | A1 * | 7/2011 | Bietsch | 42/90 |
| 2011/0252688 | A1 * | 10/2011 | Bietsch | 42/90 |

* cited by examiner

*Primary Examiner* — Jonathan C Weber
(74) *Attorney, Agent, or Firm* — Kali Law Group, P.C.

(57) ABSTRACT

Firearm sight tools for removing and installing a firearm sight are presented, the firearm sight tool including: a tool frame having a top wall, a bottom wall, and sidewalls, the sidewalls connecting the top wall and the bottom wall; a firearm clamping assembly including, a stationary jaw, a clamping spindle, a clamping jaw, and a clamping spindle handle; a bottom spacer removably attached with the bottom wall, the bottom spacer selected to provide vertical alignment; and a sight press assembly including, a carriage, a carriage spindle, and a sight carriage where the sight carriage includes a sight blade aligned along the carriage spindle.

17 Claims, 4 Drawing Sheets

FIREARM SIGHT TOOL

BACKGROUND

Currently there exist a variety of options for firearm sights for firearms over manufacturer supplied sights. Although procedures for removing and installing firearm sights are relatively simple, often, specialized tooling is required. In conventional solutions, specialized hand presses constructed to a specific brand of firearm have been provided. However, in some cases, out-of-brand firearms may have structures that interfere with specialized tooling. In addition, many conventional hand presses may lack the ability to properly align firearm sights with the tool and may therefore damage or otherwise mar firearm surfaces inadvertently. Furthermore, some conventional solutions may not properly support a firearm slide where slides are longer or heavier than normal. Still further, in some instances, conventional hand presses may not be configured to apply sufficient pressure to dislodge a firearm sight that might otherwise benefit from striking by a non-marring striking tool. As such, firearm sight tools are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

Firearm sight tools for removing and installing a firearm sight are presented, the firearm sight tool including: a tool frame having a top wall, a bottom wall, and sidewalls, the sidewalls connecting the top wall and the bottom wall; a firearm clamping assembly including, a stationary jaw removeably attached with one of the sidewalls, a clamping spindle threadably engaged with and extending through the other of the sidewalls, a clamping jaw removably and rotatably attached with the clamping spindle, where the clamping spindle is configured to move the clamping jaw toward and away from the stationary jaw, and a clamping spindle handle positioned opposite the clamping jaw on the clamping spindle, the clamping spindle handle provided to rotate the clamping spindle; a bottom spacer removably attached with the bottom wall, the bottom spacer selected to provide vertical alignment; and a sight press assembly including, a carriage spindle extending through and rotatably engaged with the sidewalls, a carriage spindle head positioned at one end of the carriage spindle, the carriage spindle head provided to rotate the carriage spindle, and a sight carriage having an upper portion and a lower portion, where the upper portion is threadedly engaged with the carriage spindle such that the sight carriage moves transversely along the tool frame, and where the sight carriage includes a sight blade positioned along the lower portion, the sight blade aligned along the carriage spindle.

In some embodiments, firearm sight tools further include: a pair of tool ports disposed opposite one another in each of the tool frame sidewalls, the pair of tool ports and in substantial alignment with each other, and a pair of tool port alignment hashes centered on each of the pair of tool ports along an outside surface of the tool sidewalls. In some embodiments, firearm sight tools further include: a limit indicator slidingly engaged with either of the pair of tool ports, the limit indicator including, a shaft sized to slidingly engage either of the pair of tool ports, the shaft having a shaft cross-sectional profile, a finger handle disposed along an end of the shaft, a limit marking disposed along the shaft for visually indicating when the firearm sight comes into mechanical communication with the sidewall of the tool frame. In some embodiments, the stationary jaw further includes a stationary jaw alignment hash disposed on the stationary jaw in axial alignment with the clamping spindle and the pair of tool ports, and where the clamping jaw further includes a clamping jaw alignment hash disposed on the removable clamping jaw in axial alignment with the clamping spindle and the pair of tool ports.

In some embodiments, firearm sight tools further include: a slide support assembly removably attached along the bottom wall of the tool frame, the slide support assembly including, a support base configured to engage the bottom wall of the tool frame, the support base forming a planar surface, and a slide support disposed along a distal end of the support base, the slide support including a support shaft mechanically coupled with the support base for providing an elevation adjustment, and at least one attachment point disposed along a proximal end of the support base. In some embodiments, the slide support further includes: a support pad disposed along an end of the support shaft opposite the support base. In some embodiments, firearm sight tools further include: a vise adapter block removably attached with the bottom wall of the tool frame, where the vise adapter block further includes a rotation element disposed between vice adapter block and the bottom wall of the tool frame, where the rotation element includes a rotation locking element for locking the tool frame in a selected position with respect to the vise adapter block.

In other embodiments, methods for using a firearm sight tool on a firearm barrel slide having a firearm sight are presented, the method including: locating the firearm barrel slide on the firearm sight tool, the firearm sight tool including, a tool frame having a top wall, a bottom wall, and sidewalls, the sidewalls connecting the top wall and the bottom wall, a firearm clamping assembly including, a stationary jaw removeably attached with one of the sidewalls, a clamping spindle threadably engaged with and extending through the other of the sidewalls, a clamping jaw removably and rotatably attached with the clamping spindle, where the clamping spindle is configured to move the clamping jaw toward and away from the stationary jaw, and a clamping spindle handle positioned opposite the clamping jaw on the clamping spindle, the clamping spindle handle provided to rotate the clamping spindle, a bottom spacer removably attached with the bottom wall, the bottom spacer selected to provide vertical alignment, and a sight press assembly including, a carriage spindle extending through and rotatably engaged with the sidewalls, a carriage spindle head positioned at one end of the carriage spindle, the carriage spindle head provided to rotate the carriage spindle, and a sight carriage having an upper portion and a lower portion, where the upper portion is threadedly engaged with the carriage spindle such that the sight carriage moves transversely along the tool frame, and where the sight carriage includes a sight blade positioned along the lower portion, the sight blade aligned along the carriage spindle; aligning the firearm sight with the sight blade in the firearm sight tool; clamping the firearm barrel slide in the firearm sight tool with the firearm clamping assembly; and actuating the sight press assembly to engage the firearm sight.

In some embodiments, methods further include: supporting the firearm barrel slide with a slide support assembly, the slide support assembly removably attached along the bottom wall of the tool frame, the slide support assembly including, a support base configured to engage the bottom wall of the tool frame, the support base forming a planar surface, and a slide support disposed along a distal end of the support base, the slide support including a support shaft mechanically coupled with the support base for providing an elevation adjustment, and a support pad disposed along an end of the support shaft opposite the support base

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
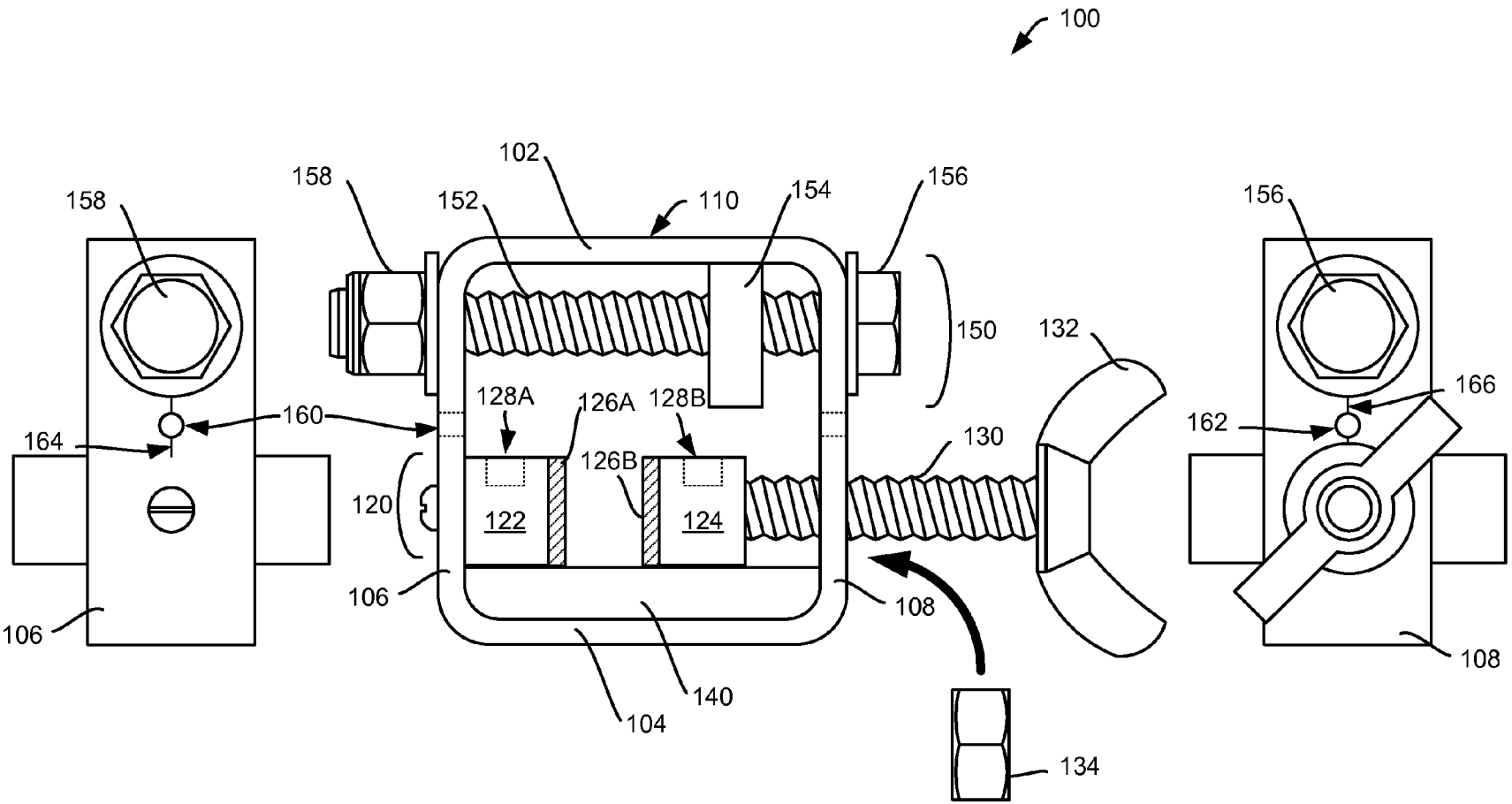
FIG. 1 is an illustrative representation of a firearm sight tool in accordance with embodiments of the present invention.

FIG. 1 is an illustrative representation of a firearm sight tool 100 in accordance with embodiments of the present invention. In particular, firearm sight tool 100 includes tool frame 110 having top wall 102, bottom wall 104, and sidewalls 106 and 108. As illustrated, tool frame 110 is a unitary structure in a substantially square shape. However, no such limitation as to manufacturing method or general shape is intended or contemplated. Indeed, any suitable shape or method of manufacture for tool frames as contemplated herein may be suitable for embodiments described. As illustrated, tool frame 110 may be useful for housing various components and assemblies for firearm sight tool embodiments. For example, firearm sight tool 100 includes a firearm clamping assembly 120 that includes stationary jaw 122, clamping jaw 124, and clamping spindle 130. Stationary jaw 122 may, in embodiments, be removably attached with sidewall 106, which attachment may be accomplished utilizing any method known in the art without departing from embodiments herein. Stationary jaw 122 may include removable facing material 126A disposed along the face of the jaw for preventing marring of a firearm surface. Facing materials may be selected from a variety of materials such as a polymeric composition, a DELRIN® composition, a TEFLON® composition, an aluminum composition, a copper composition, and a lead composition without limitation and without departing from embodiments herein. Further, stationary jaw 122 may include sight holder 128A disposed along stationary jaw top surface for temporarily holding a firearm sight during removal or installation. In some embodiments, sight holder may include a magnetic material, a magnet, a suction cup, and a tacky material without limitation. Stationary jaw embodiments will be described in further detail below for FIGS. 3 and 4.

Further illustrated, clamping jaw 124 may, in embodiments, be removably and rotatably attached with clamping spindle 130, which is configured to move clamping jaw 124 toward and away from stationary jaw 122. Clamping jaw 124 may include removable facing material 126B disposed along the face of the jaw for preventing marring of a firearm surface. Facing materials may be selected from a variety of materials such as a polymeric composition, a DELRIN® composition, a TEFLON® composition, an aluminum composition, a copper composition, and a lead composition without limitation and without departing from embodiments herein. Further, clamping jaw 124 may include sight holder 128E disposed along stationary jaw top surface for temporarily holding a firearm sight during removal or installation. In some embodiments, sight holders may include a magnetic material, a magnet, a suction cup, and a tacky material. Clamping jaw embodiments will be described in further detail below for FIGS. 3 and 4.

In order to providing clamping pressure, clamping spindle 130 may be threadably engaged with and extending through sidewall 108. In some embodiments, a threaded nut 134 may be mechanically coupled with sidewall 108 to provide threaded engagement. In other embodiments, sidewall 108 may include a threaded throughway to provide threaded engagement. It may be appreciated that any type of clamping mechanism known in the art may be utilized without departing from embodiments provided herein. For example, in some embodiments, a pneumatically actuated cylinder may provide a clamping mechanism. In other embodiments, a lever actuated clamp may provide a clamping mechanism. In the illustrated embodiment, clamping spindle 130 may include clamping spindle handle 132 positioned opposite clamping jaw 124 to provide rotational input to clamping spindle 130. Further illustrated is bottom spacer 140 removably attached with bottom wall 104. In embodiments, bottom spacer 140 may be selected to provide vertical adjustment for firearm barrel slides. Thus, any appropriately sized bottom spacer may be utilized without departing from embodiments provided herein.

In order to remove or install a firearm sight, sight press assembly 150 may be actuated. As illustrated, sight press assembly 150 includes carriage spindle 152 extending through and rotatably engaged with sidewalls 106 and 108. In order to rotate carriage spindle 152, one or more carriage spindle heads 156 and 158 may be provided. As illustrated, carriage spindle heads 156 and 158 are hexagonally shaped, although any suitable shape or handle may be utilized to rotate carriage spindles without departing from embodiments herein. Sight press assembly 150 may further include sight carriage 154 that may be threadedly engaged with carriage spindle 152 such that sight carriage 154 moves transversely along tool frame 110. Sight carriage embodiments will be discussed in further detail below for FIG. 5.

In some embodiments, a pair of tool ports 160 and 162 may be provided along sidewalls 106 and 108 respectively. Tool ports 160 and 162 may be disposed opposite from and substantial in alignment with each another. Tool ports may provide access to a firearm sight by a variety of tools. For example, a striking tool such as a drift or punch may be inserted into a tool port in order to strike or mark a firearm sight. In some embodiments, a limit indicator may be utilized to indicate when a firearm sight comes into mechanical communication with a sidewall of tool frame 110 to avoid damage or marring of the firearm sight. Limit indicator embodiments will be discussed in further detail below for FIG. 6. In some embodiments, a pair of tool port alignment hashes 164 and 166 may be provided that may be centered on tool ports 160 and 162 along tool sidewalls 106 and 108. Tool port alignment hashes may provide a more accurate reading of alignment to avoid damage or marring of a firearm sight.

Figure 2:
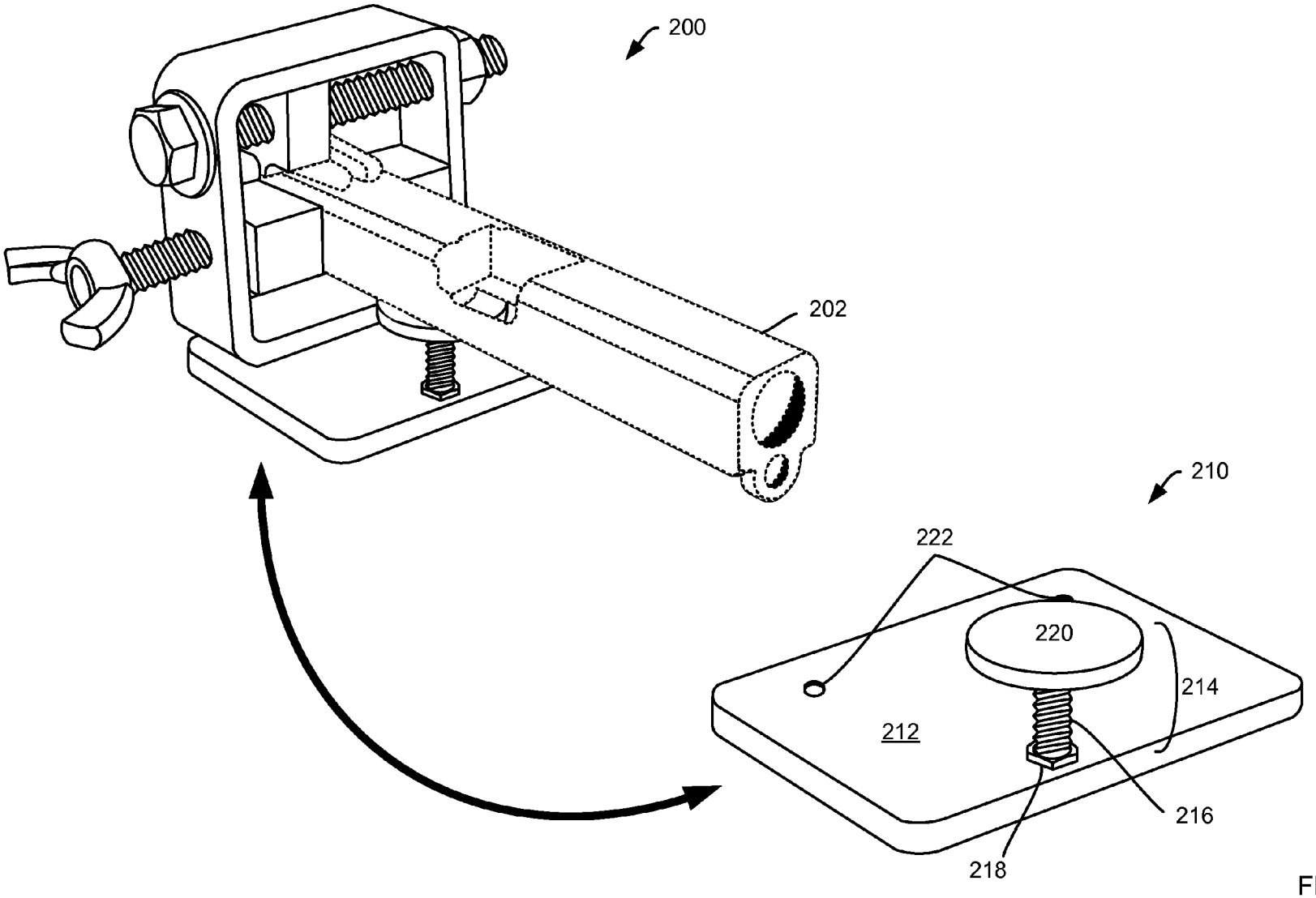
FIG. 2 is an illustrative representation of a firearm sight tool having a slide support assembly in accordance with embodiments of the present invention.

FIG. 2 is an illustrative representation of a firearm sight tool 200 having a slide support assembly 210 in accordance with embodiments of the present invention. As illustrated, slide support assembly 210 may be removably attached along a tool frame bottom wall of firearm sight tool 200. In embodiments, support assembly may be utilized to support firearm barrel slide 202, which may be desirable in examples where firearm barrel slides are especially long or heavy. As illustrated, slide support assembly 210 includes support base 212 that forms a planar surface. Slide support assembly 210 further includes slide support 214 disposed along a distal end of support base 212. In order to provide elevation adjustment, in some embodiments, support shall 216 may be mechanically coupled with support base 212. In some embodiments, support shafts may be threadably engaged with and extending through support base 212. In some embodiments, a threaded nut 218 may be mechanically coupled with support base 212 to provide threaded engagement. In other embodiments, support bases may include a threaded throughway to provide threaded engagement. Further as illustrated, support pad 220 may be disposed long an end of support shaft 216 opposite support base 212. Support pads may be faced with any non-marring material without limitation and without departing from embodiments herein. Still further as illustrated, slide support assembly 210 may include at least one attachment point 222 disposed along a proximal end of support base 212.

It may be appreciated that other assemblies may be attached with firearm sight tool embodiments. For example, in an embodiment, a vise adapter block (not shown) may be removably attached with a bottom wall of a tool frame so that firearm sight tools may be stabilized while in use. In some embodiments, vise adapter block embodiments may further include a rotation element disposed between a vice adapter block and a bottom wall of the tool frame, where the rotation element includes a rotation locking element for locking the tool frame in a selected position with respect to the vise adapter block.

Figure 3:
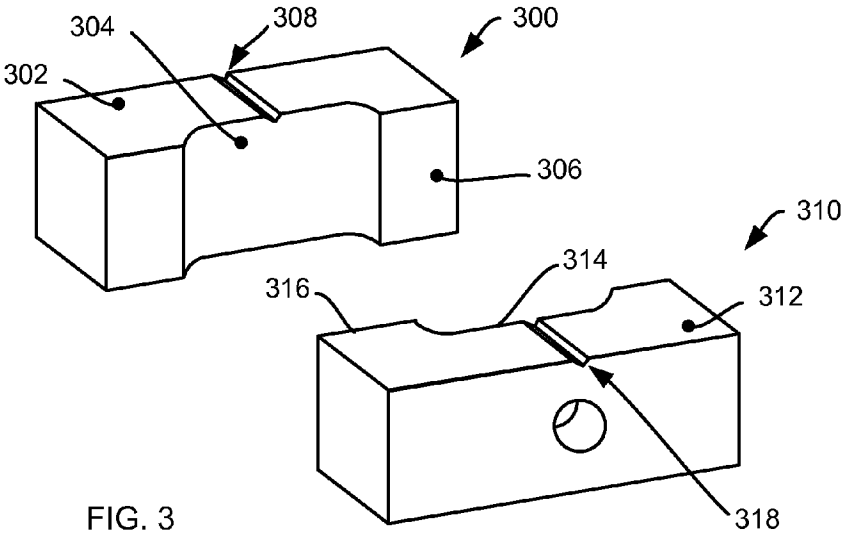
FIG. 3 is an illustrative representation of a stationary jaw and a clamping jaw in accordance with embodiments of the present invention.

FIG. 3 is an illustrative representation of stationary jaw 300 and a clamping jaw 310 in accordance with embodiments of the present invention. In the embodiment illustrated, stationary jaw 300 includes a rectangular block configuration having top surface 302 and vertical surfaces extending therefrom. As illustrated, one vertical surface includes stationary jaw face 306 that includes cut-out portion 304 disposed along stationary jaw face 306. As may be appreciated, cut-out portion 304 may provide clearance for a firearm barrel slides in embodiments herein. In further embodiments illustrated, stationary jaw 300 may include alignment hash 308 disposed in axial alignment with clamping spindle (FIG. 1, 130) and tool ports (FIGS. 1, 160 and 162). In the embodiment illustrated, alignment hash 308 is a vee-channel formed on the stationary jaw surface; however any alignment hash may be machined, scribed, printed, or drawn without departing from embodiments.

In like manner, clamping jaw 310 is illustrated in an opposing view. As illustrated, clamping jaw 310 includes a rectangular block configuration having top surface 312 and vertical surfaces extending therefrom. As illustrated, one vertical surface includes clamping jaw face 316 that includes cut-out portion 314 disposed along clamping jaw face 316. As may be appreciated, cut-out portion 314 may provide clearance for a firearm barrel slides in embodiments herein. In further embodiments illustrated, clamping jaw 310 may include alignment hash 318 disposed in axial alignment with clamping spindle (FIG. 1, 130) and tool ports (FIGS. 1, 160 and 162). In the embodiment illustrated, alignment hash 318 is a vee-channel formed on the clamping jaw surface; however any alignment hash may be machined, scribed, printed, or drawn without departing from embodiments.

Figure 4:
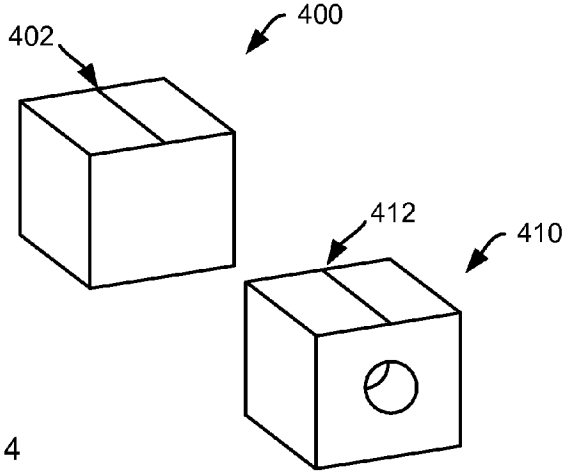
FIG. 4 is an illustrative representation of a stationary jaw and a clamping jaw in accordance with embodiments of the present invention.

FIG. 4 is an illustrative representation of stationary jaw 400 and clamping jaw 410 in accordance with embodiments of the present invention. As illustrated, stationary jaw 400 and clamping jaw 410 do not include a cut-out portion as illustrated for FIG. 3. It may be appreciated that while some firearms may benefit from a cut-out portion to provide clearance from interferences on a firearm barrel slide, other firearms have no such requirements. As such many different configurations of stationary jaws and clamping jaws may be utilized without departing from the present invention. In addition, stationary jaw 400 may include alignment hash 402 disposed in axial alignment with clamping spindle (FIG. 1, 130) and tool ports (FIGS. 1, 160 and 162). In the embodiment illustrated, alignment hash 402 is printed on stationary jaw 400. Further, clamping jaw 410 may include alignment hash 412 disposed in axial alignment with clamping spindle (FIG. 1, 130) and tool ports (FIGS. 1, 160 and 162). In the embodiment illustrated, alignment hash 412 is printed on clamping jaw 400.

Figure 5:
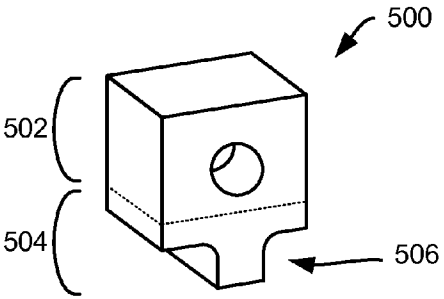
FIG. 5 is an illustrative representation of a sight carriage in accordance with embodiments of the present invention.

FIG. 5 is an illustrative representation of sight carriage 500 in accordance with embodiments of the present invention. As illustrated, sight carriage 500 includes upper portion 502 and lower portion 504. Is illustrated in FIG. 1 upper portion 502 may be threadedly engaged with a carriage spindle such that sight carriage 500 moves transversely along the tool frame. In addition, sight carriage 500 includes sight blade 506 positioned along lower portion 504 and aligned along the carriage spindle. It may be appreciated that sight blades may be configured in any manner to appropriately engage a firearm sight without departing from embodiments herein. In some embodiments, sight blades may be removably attached with carriage spindles such that custom sight blades of varying size and shape may be utilized.

Figure 6:
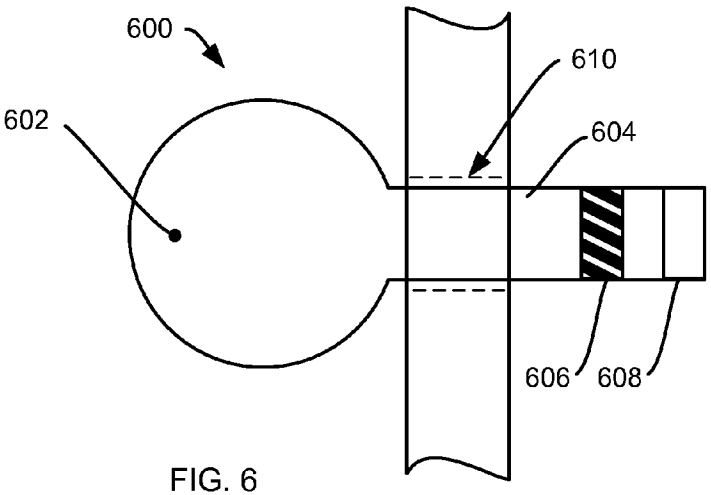
FIG. 6 is an illustrative representation of a limit indicator in accordance with embodiments of the present invention.

FIG. 6 is an illustrative representation of limit indicator 600 in accordance with embodiments of the present invention. As noted above, limit indicators may be utilized to indicate when a firearm sight comes into mechanical communication with a tool frame sidewall. Limit indicators may be desirable to avoid damaging or marring firearm sights. As such, limit indicator 600 may be inserted through tool port 610 and include finger handle 602 for easily grasping the indicator. Further as illustrated, limit indicator 600 may include shaft 604 sized to slidingly engage either of the pair of tool ports. It may be appreciated that shaft 604 includes a shaft cross-sectional profile (not shown). Limit indicator 600 may further include limit marking 606 disposed along shaft 604 for visually indicating when the firearm sight comes into mechanical communication with the sidewall of the tool frame. Limit indicator may be enabled utilizing any number of patterns and colors without departing from embodiments herein. Still further, in some embodiments, limit indicator 600 may include magnet 608 disposed along end of shaft 604 where magnet 600 may be shaped to at least equal to or less than the shaft cross-sectional profile. In embodiments, magnets or suction cups may ensure mechanical coupling with a firearm sight.

Figure 7:
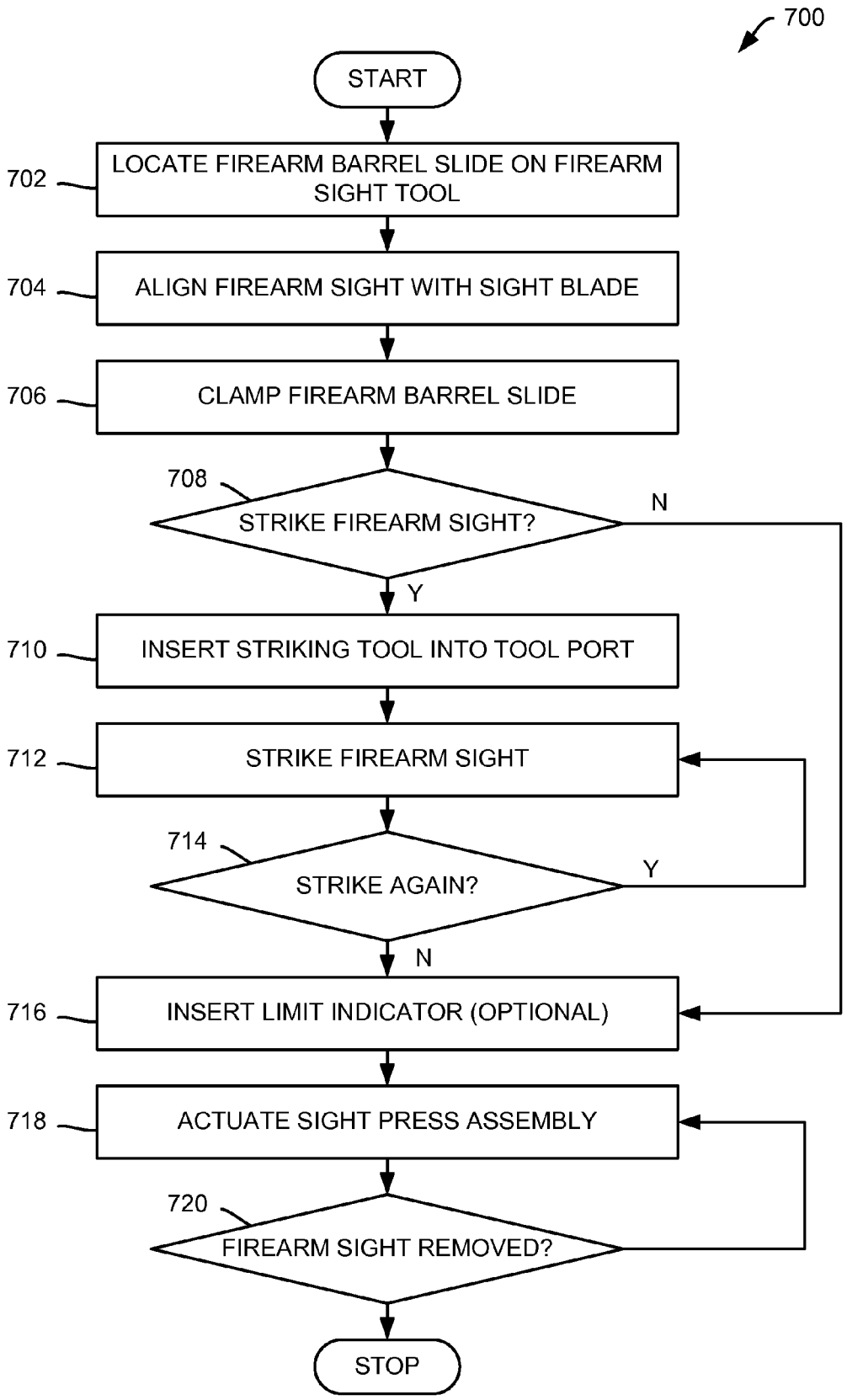
FIG. 7 is an illustrative flowchart of methods for utilizing a firearm sight tool in accordance with embodiments of the present invention.

FIG. 7 is an illustrative flowchart 700 of methods for utilizing a firearm sight tool in accordance with embodiments of the present invention. As such, at a step 702 the method locates a firearm barrel slide on firearm sight tool embodiments. In embodiments, the firearm barrel slide may be located on a bottom spacer sized to provide vertical alignment. In some embodiments utilizing a barrel support assembly, the firearm barrel slide may be leveled or supported with respect to the firearm sight tool. The method continues to a step 704 to align a firearm sight with a sight blade. To aid in alignment, tool ports having alignment hashes may be utilized such that aligning the firearm sight proceeds by visually sighting the firearm sight along the tool ports. In other embodiments, stationary jaws and clamping jaws may include alignment hashes for aligning firearm sights with sight blades such that aligning the firearm sight proceeds by visually sighting the firearm sight along the stationary jaw and clamping jaw alignment hashes.

The method continues to a step 706 to clamp the firearm barrel slide in the tool whereupon the method determines whether to strike the firearm sight at a step 708. If the method determines at a step 708 not to strike the firearm sight, the method continues to a step 716. If the method determines at a step 708 to strike the firearm sight, the method continues to a step 710 to insert a striking tool into a tool port and striking the firearm sight with the sticking tool at a step 712. At a next step 714, the method determines whether to strike the firearm sight again. If the method determines at a step 714 to strike the firearm sight again, the method continues to step 712. If the method determines at a step 714 not to strike the firearm sight again, the method continues to a step 716. It may be appreciated that in some examples, a firearm sight may be lodged in a manner that benefits from striking by a striking tool. It is not generally contemplated that removal or installation of a firearm sight proceeds by merely striking the sight although that method is possible under embodiments described herein. Rather, removal or installation of a firearm sight will generally proceed by actuating the sight press assembly.

Therefore, at a next step 716, the method optionally inserts a limit indicator into a tool port. As noted above, a limit indicator may be provided to indicate when a firearm sight comes into mechanical communication with a sidewall to avoid damaging or marring the firearm sight. At a next step 718, the method actuates the sight press assembly. In operation, actuating the sight press assembly causes the sight carriage to traverse the firearm sight tool frame to remove or install a firearm sight. At a next step 720, the method determines whether the firearm sight has been removed. If the method determines at a step 720 that the firearm sight is not removed, the method returns to a step 718 to actuate the sight press assembly. If the method determines at a step 720 that the firearm sight is removed, the method ends.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A firearm sight tool for removing and installing a firearm sight, the firearm sight tool including:

a tool frame having a top wall, a bottom wall, and sidewalls, the sidewalls connecting the top wall and the bottom wall;

a firearm clamping assembly including, a stationary jaw removeably attached with one of the sidewalls, wherein the stationary law includes a rectangular block configuration having a top surface and vertical surfaces extending therefrom, where one of the vertical surfaces includes a stationary law face, where the stationary jaw face includes a first cut-out portion disposed alone the stationary jaw face, where the first cut-out provides clearance for a firearm barrel slide, a clamping spindle threadably engaged with and extending through the other of the sidewalls, a clamping jaw removably and rotatably attached with the clamping spindle, where the clamping spindle is configured to move the clamping jaw toward and away from the stationary jaw, wherein the clamping jaw includes a rectangular block configuration having a top surface and vertical surfaces extending therefrom, where one of the vertical surfaces includes clamping jaw face, where the clamping jaw face includes a second cut-out portion disposed along the clamping jaw face, where the second cut-out portion provides clearance for a firearm barrel slide, and a clamping spindle handle positioned opposite the clamping jaw on the clamping spindle, the clamping spindle handle provided to rotate the clamping spindle;

a bottom spacer removably attached with the bottom wall, the bottom spacer selected to provide vertical alignment; and a sight press assembly including, a carriage spindle extending through and rotatably engaged with the sidewalls, at least one carriage spindle head positioned at one end of the carriage spindle, the at least one carriage spindle head provided to rotate the carriage spindle, and a sight carriage having an upper portion and a lower portion, where the upper portion is threadedly engaged with the carriage spindle such that the sight carriage moves transversely along the tool frame, and where the sight carriage includes a sight blade positioned along the lower portion, the sight blade aligned along the carriage spindle.

2. The firearm sight tool of claim 1, further including:

a pair of tool ports disposed opposite one another in each of the tool frame sidewalls, the pair of tool ports and in substantial alignment with each other, and a pair of tool port alignment hashes centered on each of the pair of tool ports along an outside surface of the tool sidewalls.

3. The firearm sight tool of claim 2, further including:

a limit indicator slidingly engaged with either of the pair of tool ports, the limit indicator including, a shaft sized to slidingly engage either of the pair of tool ports, the shaft having a shaft cross-sectional profile, a finger handle disposed along an end of the shaft, a limit marking disposed along the shaft for visually indicating when the firearm sight comes into mechanical communication with the sidewall of the tool frame.

4. The firearm sight tool of claim 3, further including:

a magnet disposed along another end of the shaft, the magnet shaped to at least equal to or less than the shaft cross-sectional profile.

5. The firearm sight tool of claim 2, where the stationary jaw further includes a stationary jaw alignment hash disposed on the stationary jaw in axial alignment with the clamping spindle and the pair of tool ports, and where the clamping jaw further includes a clamping jaw alignment hash disposed on the removable clamping jaw in axial alignment with the clamping spindle and the pair of tool ports.

6. The firearm sight tool of claim 1, where the stationary jaw further includes a first sight holder disposed along a stationary jaw top surface for temporarily holding the firearm sight, and where the clamping jaw further includes a second sight holder disposed along a stationary jaw top surface for temporarily holding the firearm sight.

7. The firearm sight tool of claim 6, where the first sight holder and the second sight holder are selected from the group consisting of: a magnetic material, a magnet, a suction cup, and a tacky material.

8. The firearm sight tool of claim 1, where the stationary jaw and the clamping jaw further include a removable facing material disposed along a stationary jaw face and a clamping jaw face for preventing marring of a firearm surface.

9. The firearm sight tool of claim 1, further including:

a slide support assembly removably attached along the bottom wall of the tool frame, the slide support assembly including, a support base configured to engage the bottom wall of the tool frame, the support base forming a planar surface, a slide support disposed along a distal end of the support base, the slide support including a support shaft mechanically coupled with the support base for providing an elevation adjustment, and at least one attachment point disposed along a proximal end of the support base.

10. The firearm sight tool of claim 9, where the slide support further includes:

a support pad disposed along an end of the support shaft opposite the support base.

11. A method for using a firearm sight tool on a firearm barrel slide having a firearm sight, the method including:

locating the firearm barrel slide on the firearm sight tool, the firearm sight tool including, a tool frame having a top wall, a bottom wall, and sidewalls, the sidewalls connecting the top wall and the bottom wall, a firearm clamping assembly including, a stationary jaw removeably attached with one of the sidewalls, wherein the stationary jaw includes a rectangular block configuration having a top surface and vertical surfaces extending therefrom, where one of the vertical surfaces includes a stationary jaw face, where the stationary jaw face includes a first cut-out portion disposed along the stationary jaw face, where the first cut-out provides clearance for a firearm barrel slide, a clamping spindle threadably engaged with and extending through the other of the sidewalls, a clamping jaw removably and rotatably attached with the clamping spindle, where the clamping spindle is configured to move the clamping jaw toward and away from the stationary jaw, wherein the clamping jaw includes a rectangular block configuration having a top surface and vertical surfaces extending therefrom, where one of the vertical surfaces includes clamping jaw face, where the clamping jaw face includes a second cut-out portion disposed along the clamping jaw face, where the second cut-out portion provides clearance for a firearm barrel slide, and a clamping spindle handle positioned opposite the clamping jaw on the clamping spindle, the clamping spindle handle provided to rotate the clamping spindle, a bottom spacer removably attached with the bottom wall, the bottom spacer selected to provide vertical alignment, and a sight press assembly including, a carriage spindle extending through and rotatably engaged with the sidewalls, at least one carriage spindle head positioned at one end of the carriage spindle, the at least one carriage spindle head provided to rotate the carriage spindle, and a sight carriage having an upper portion and a lower portion, where the upper portion is threadedly engaged with the carriage spindle such that the sight carriage moves transversely along the tool frame, and where the sight carriage includes a sight blade positioned along the lower portion, the sight blade aligned along the carriage spindle;

aligning the firearm sight with the sight blade in the firearm sight tool;

clamping the firearm barrel slide in the firearm sight tool with the firearm clamping assembly; and actuating the sight press assembly to engage the firearm sight.

12. The method of claim 11, further including:

aligning the firearm sight by visually sighting the firearm sight along a pair of tool ports, the pair of tool ports disposed opposite one another in each of the tool frame sidewalls, the pair of tool ports and in substantial alignment with each other.

13. The method of claim 12 further including:

aligning the firearm sight by visually sighting the firearm sight along a pair of tool port alignment hashes centered on each of the pair of tool ports along an outside surface of the tool sidewalls.

14. The method of claim 12 further including:

aligning the firearm sight by visually sighting the firearm sight along a stationary jaw alignment hash disposed on the stationary jaw in axial alignment with the clamping spindle and the pair of tool ports; and aligning the firearm sight by visually sighting the firearm sight along a clamping jaw alignment hash disposed on the removable clamping jaw in axial alignment with the clamping spindle and the pair of tool ports.

15. The method of claim 12, further including:

striking the firearm sight with a striking tool, the striking tool configured to slidingly engage either of the pair of tool ports.

16. The method of claim 12, further including:

utilizing a limit indicator to indicate when the firearm sight has come into mechanical communication with the sidewall of the tool frame, the limit indicator slidingly engaged with either of the pair of tool ports, the limit indicator including, a shaft sized to slidingly engage either of the pair of tool ports, the shaft having a shaft cross-sectional profile, a finger handle disposed along an end of the shaft, a limit marking disposed along the shaft for indicating when the firearm sight comes into mechanical communication with the sidewall of the frame.

17. The method of claim 11, further including:

supporting the firearm barrel slide with a slide support assembly, the slide support assembly removably attached along the bottom wall of the tool frame, the slide support assembly including, a support base configured to engage the bottom wall of the tool frame, the support base forming a planar surface, a slide support disposed along a distal end of the support base, the slide support including a support shaft mechanically coupled with the support base for providing an elevation adjustment, and a support pad disposed along an end of the support shaft opposite the support base.

* * * * *